United States Patent [19]

Gach

[11] 4,371,088

[45] Feb. 1, 1983

[54] TAMPER INDICATING CHILD RESISTANT CLOSURE

[75] Inventor: Peter P. Gach, Evansville, Ind.

[73] Assignee: Sunbeam Plastics Corporation, Evansville, Ind.

[21] Appl. No.: 300,792

[22] Filed: Sep. 10, 1981

[51] Int. Cl.[3] ..... B65D 55/02

[52] U.S. Cl. ..... 215/220

[58] Field of Search ..... 215/219, 220, 250, 251, 215/253

[56] References Cited

U.S. PATENT DOCUMENTS 3,338,444 8/1967 Velt ..... 215/220

4,281,771 8/1981 Siegel ..... 215/220

4,330,067 5/1982 Devssen ..... 215/220

*Primary Examiner*—George T. Hall

*Attorney, Agent, or Firm*—Fisher, Gerhardt, Crampton & Groh

[57] ABSTRACT

A tamper indicating child resistant closure for containers of two pieces in the form of a pair of telescoped caps. Opening movement requires deformation of the outer cap relative to the inner cap. Such deformation acts to break away an indicator element formed integrally with the outer cap to form an opening giving evidence that the closure has been put in condition for opening.

10 Claims, 5 Drawing Figures

TAMPER INDICATING CHILD RESISTANT CLOSURE

This invention relates to screw type closures for containers which are both child-resistant and tamper indicating.

A variety of screw type, child proof, or child resistant closures and containers have been provided which require two distinct operations to achieve opening. It also is desirable to have such closures be tamper proof or tamper indicating so that any attempt to open the container once it has been filled is indicated by some means which can be observed. Also, it is desirable that the child resistant feature remains operable for repeated opening and closing whereas the tamper indicating arrangement is required to operate only the first time the container is opened.

It is an object of the invention to provide a child resistant tamper indicating closure.

Another object of the invention is to provide a child resistant tamper indicating closure of the push and turn type in which deflection of an outer cap relative to a screw threaded cap is required to remove the closure from the container.

The objects of the invention are accomplished by a tamper indicating child resistant closure having a relatively rotatable inner and outer caps with the inner cap being internally threaded for engagement with threads on a container. Ribs on the cap and complementary lugs on the outer cap form a first set of engaging surfaces by which the inner cap can be turned in a closing direction upon rotation of the outer cap and a second set of engaging surfaces which can be engaged to turn the inner cap in an opposite direction to remove the closure from the container. The second set of engaging surfaces can only be brought into engagement with each other upon axial deflection of at least a portion of the outer cap relative to the inner cap and such deflection causes an indicator element formed as a unit with the cap but separated therefrom by weakened portions such as frangible webs to break away from the outer cap so that the loose or absent indicator element gives evidence that there has been tampering with the closure.

The preferred embodiment of the invention is illustrated in the drawings in which.

Figure 2:
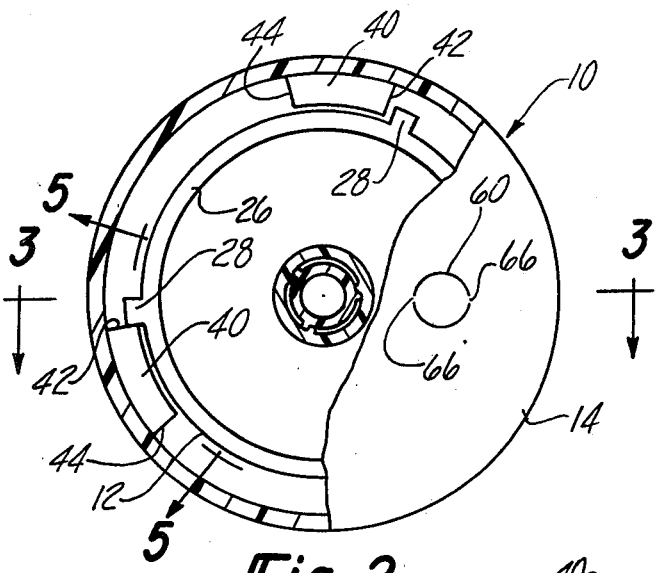
FIG. 2 is a cross sectional view at an enlarged scale taken on line 2—2 in FIG. 3.

A tamper indicating child resistant closure embodying the invention is designated generally at 10 and includes an inner cap 12 and an outer cap or driver 14. The cap 12 has a flat, disc shaped top 16 and a depending cylindrical skirt 18, the inner surface of which is provided with threads 20 adapted to mate with complementary threads on a neck 22 of a container 24, only a portion of which is shown.

The cap 12 has an annular rim 26 formed integrally on the circumference of the cap top 16 and a plurality of ribs 28 which extend generally axially and are formed on the outer surface of the skirt 18 and rim 26. Preferably, three such ribs are uniformly spaced 120 degrees apart.

The driver 14 has a flat disc shaped top 32 and a depending cylindrical skirt 34 which telescopes over the cap 12. The cap 12 and driver 14 are disposed concentrically in nested relationship and the driver skirt 34 is provided with a radially inwardly directed lip 36 which is engageable with a radially outwardly extending flange 38 on the cap 12 to permit a limited axial movement of the cap 12 and driver 14 but maintains them in assembled and nested relationship.

The driver 14 is provided with a series of driving lugs 40 formed integrally with the driver at the junction of the driver top 32 and the skirt 34. The driving lugs or members 40 correspond in number and spacing to the ribs 28 on a cap 12.

Each of the lugs 40 extends arcuately between the rim 26 and the inner surface of the driver skirt 34. Each lug 40 has a pair of oppositely facing surfaces 42 and 44 with the forward surface 42 having a larger axial extent than the rear surface 44. The surfaces 42 and 44 are joined by an inclined cam or ramp surface 46.

The cap 12 and driver 14 are held apart at their axes by spacer means in the form of telescoping collars 48 and 50 formed on the cap 12 and driver 14, respectively. The collars 48 and 50 are concentric with each other and coaxial with the cap 12 and driver 14 and serve to maintain the cap 12 and driver 14 in axially spaced relationship to each other.

The driver 14 is provided with an indicator element 60 which is separable from the driver 14 but is molded integrally therewith. Both the cap 12 and the driver 14 are molded from a plastic material, for example, polystyrene or polypropylene with the inner cap 12 being of a relatively stiffer more rigid plastic material than the driver 14. The driver 14 may be of the same material but with a greater amount of plasticizer to make it relatively more flexible.

Figure 3:
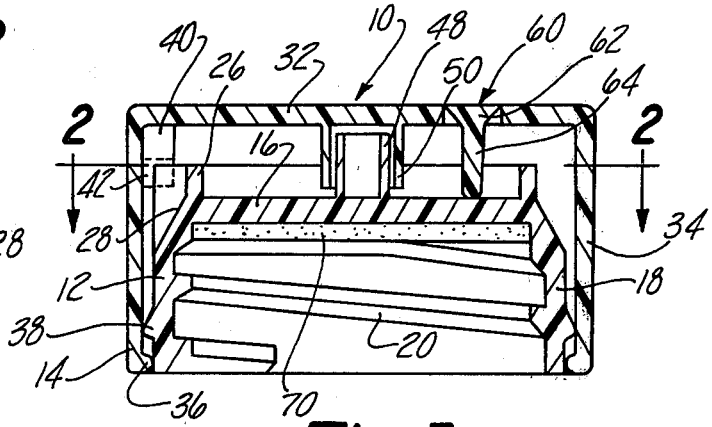
FIG. 3 is a cross-sectional view taken on line 3—3 in FIG. 2.

The indicator element 60 has a head portion 62 and a projecting stem 64 which in the normal position of the cap 12 and driver 14 as seen in FIG. 3 extends in close proximity to the disc top 16 of the cap 12. The indicator element 60 is intended to be broken away from the disc top 32 of the driver 14 during the opening operation of the closure and for that purpose the head 62 is connected to the remainder of the driver top 32 by means of weakened portions such as frangible webs 66.

Figure 5:
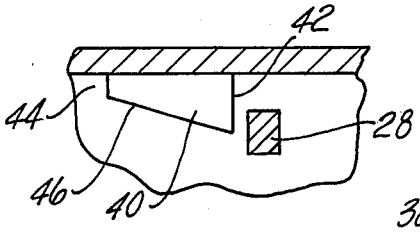
FIG. 5 is a cross-sectional view of a portion of the closure taken on line 5—5 in FIG. 2.

In order to screw the closure 10 onto a threaded neck 22 of a container 24, the driver 14 is held by a person or an automatic capping machine, not shown, and the closure 10 is rotated in a clockwise direction relative to the neck 24 with the torque being transmitted from the driver 14 to the cap 12 by means of simultaneous engagement of the long surfaces 42 with the side surfaces of the ribs 28 as seen in FIG. 5. Torque can be applied in this manner until a seal 70 on the underside of the cap top 16 comes into tight sealing engagement with the top surface of the neck 22 of the container 24.

To remove the closure 10 from the neck 22 the cap 12 must be rotated in the opposite direction, that is, counterclockwise. Such opening rotation is accomplished with the driver 14. However, rotation of the driver 14 alone is insufficient. Rotation of the driver 14 in an opening or counterclockwise direction leaves the cap 12 threadably engaged with the neck 24 and stationary. The cam surfaces 46 engage the top of the ribs 28 and deflect or displace the driver 14 relative to the cap 12 sufficiently so that the lug 40 passes by the ribs 28. Continued rotation of the driver permits racheting of the lugs 40 and ribs 28 so that insufficient torque is transmitted to remove the cap 12. During such rotation of the driver 14 relative to the cap 12 the indicator element 60 rotates as a unit with the driver 14 without interference from any portion of the cap 12.

Figure 4:
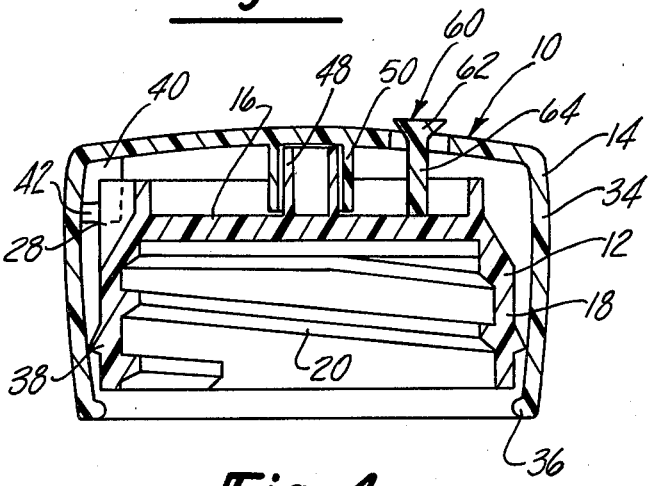
FIG. 4 is a view similar to FIG. 3 showing another condition of the closure during opening movement.
Figure 1:
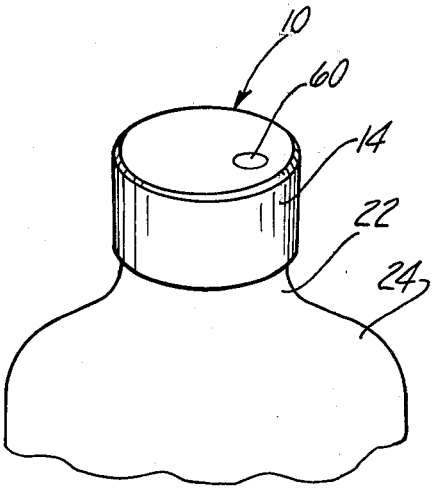
FIG. 1 is a perspective view of a tamper indicating child resistant closure embodying the invention on a container, only a portion of which is shown.

When it is desired to remove the cap 12 from the container 24, downward pressure must be applied to the outer periphery of the driver top 14 adjacent the lugs 40 to partially deform the driver 14 downwardly from the position seen in FIG. 3 to the position seen in FIG. 4. Simultaneous rotation of the deflected driver 14 in a counterclockwise direction brings the surface 44 into engagement with the side surface of the ribs 28 and additional rotation causes torque to be applied from the driver 14 to the cap 12 to permit it to be unscrewed from the container 24.

During deflection or deformation of the driver to bring the lugs 40 into engagement with the ribs 28, the bottom of the stem 64 engages the disc top 16 of the cap 12 and fractures the webs 66 so that the head 62 is separated from the disc top 32 of the driver 14. When closure 10 has been removed from the container 24 and the driver 14 relaxes and returns to its original position the indicator element 60 will fall away from the driver 14 or will be displaced from its original position in the opening 68 resulting from the removal of the head 62. This gives an indication that there has been tampering with the closure 10 in that the closure was opened or at least put in a condition for opening since it was first filled.

The tamper indicating element may take various shapes but preferably is flush with the top surface of the top 32 of the driver 14 so that its absence once the closure 10 has been opened is more readily apparent. Also, the cap 12 can be molded of a different and contrasting color to the driver 14 so that upon breaking away of the indicator element, the contrasting color can be seen through the opening 68 to emphasize tampering.

Once the closure 10 has been opened for the first time, it can be replaced repeatedly on the container 24 by rotation in a clockwise direction which causes the long surfaces 42 of the lugs 40 to engage the ribs 28 and drive the cap 12 onto the threads of the neck 22 to close the container 24.

A tamper indicating child resistant closure for containers has been provided in which opening movement requires deformation of an outer cap or driver relative to an inner cap and simultaneous turning or unscrewing movement. Such deformation simultaneously fractures webs holding an indicator element relative to the driver so that the indicator element is displaced thereby giving evidence that there has been tampering with the closure and possible opening of the container.

The embodiments of the invention in which an exclusive property or privilege is claimed are defined as follows:

1. A tamper indicating child resistant closure for containers comprising: relatively rotatable inner and outer caps, said inner cap being internally threaded for engagement with threads on a container, a first set of engaging surfaces on said caps engageable with each other to turn said inner cap in a closing direction upon rotation of said outer cap in one direction, a second set of engaging surfaces on said caps operable to turn said inner cap in an opening direction upon simultaneous engagement of said surfaces and rotation of said outer cap in an opposite direction, said second set of engaging surfaces being engageable with each other only upon axial deflection of a part of said outer cap relative to said inner cap, an indicator element on said outer cap and connected thereto by frangible webs, said indicator element having a projecting portion in proximity to said inner cap when said part of said outer cap is not deflected and being engageable with said inner cap upon axial deflection of said part of said outer cap to break said frangible webs to separate said indicator element from said outer cap.

2. The tamper indicating closure of claim 1 wherein said caps have generally parallel disc shaped tops, separator means to maintain said disc shaped tops separated from each other, said indicator means being radially spaced from said separator means.

3. The tamper indicating closure of claim 1 having spacer means associated with said inner and outer caps to maintain a portion of said outer cap which is spaced from said deflectable part in predetermined spaced relationship to a corresponding axial part of said inner cap.

4. The tamper indicating closure of claim 3 wherein said spacer means are disposed axially of said caps.

5. The tamper indicating closure of claim 3 wherein said indicator element is disposed between said spacer means and said second set of engaging surfaces.

6. A tamper indicating child resistant closure for a container having a threaded neck, said closure comprising: an inner cup-shaped cap having a disc shaped top and an annular skirt internally threaded to mate with the threaded neck of the container, an outer cup-shaped driver member having a disc shaped top and an annular skirt with an inside diameter greater than the exterior diameter of said cap skirt, said driver member being disposed coaxially of said cap, first one way drive means on adjacent parts of said cap and said driver member and engageable for screwing said cap onto the threads of the neck of said container, second one way drive means on adjacent parts of said cap and driver member and engageable for unscrewing said cap, means separating said second one way drive means except upon deflection of said driver relative to said cap, and an indicator element disposed in an initial position relative to said disc shaped top of said driver member and being in close proximity to said disc shaped top of said cap when said second one way drive means are not engaged, said indicator element being engageable with said disc shaped top of said cap and being permanently displacable from said initial position relative to said driver when said second one way drive means are engaged to indicate an opening condition.

7. The tamper indicating child resistant closure of claim 6 wherein said indicator element is attached to said disc shaped top of said driver by a weakened portion, said weakened portion being broken away from said driver upon deflection of said driver relative to said cap.

8. The tamper indicating closure of claim 7 wherein said indicator element is disposed in said disc shaped top of said driver and leaves an opening in said driver upon fracturing of said weakened portion and removal of said element.

9. The tamper indicating closure of claim 8 wherein said cap is of a contrasting color to said driver to be visible through said hole formed by removal of said indicator element.

10. The tamper indicating closure of claim 7 wherein said disc shaped tops of said cap and driver are disposed generally parallel to each other for rotation about a common axis, said means separating said cap and driver being disposed at said axis, said driver being deflectable axially at said annular skirt to bring said second one way drive means into engagement with each other and break said weakened portion for removal of said indicator element.

* * * * *